United States Patent [19]

Fear

[11] Patent Number: 4,730,766

[45] Date of Patent: Mar. 15, 1988

[54] SEALING OF VOID AREA AT THE TOP OF CUP BEAD OF HOT MELT

[75] Inventor: Robert E. Fear, Wheaton, Ill.

[73] Assignee: Continental Bondware, Inc., Rolling Meadows, Ill.

[21] Appl. No.: 811,395

[22] Filed: Dec. 20, 1985

[51] Int. Cl.[4] ..... B65D 5/08

[52] U.S. Cl. ..... 229/137; 229/3.1; 229/48 T; 229/106; 229/4.5; 493/129; 493/134; 493/157; 493/165; 493/184

[58] Field of Search ..... 229/17 R, 17 G, 3.1, 229/48 T, 485 A, 485 B, 485 C; 53/375, 477, 491, 373; 493/128–135, 152, 157, 165, 184; 156/155

[56] References Cited

U.S. PATENT DOCUMENTS

| | | | |
|---|---|---|---|
| 1,974,256 | 9/1934 | Bergstein | 493/128 |
| 3,302,846 | 2/1967 | Wilcox | 229/17 G |
| 3,389,849 | 6/1968 | Egleston | 229/17 G |
| 3,421,678 | 1/1969 | Thompson et al. | 229/17 G |
| 3,913,825 | 10/1975 | Brownlee et al. | 229/3.1 |
| 3,913,826 | 10/1975 | Brownlee et al. | 229/48 T |
| 3,944,126 | 3/1976 | Richards | 229/48 T |
| 4,442,970 | 4/1984 | Farber | 229/17 G |
| 4,603,535 | 8/1986 | Schultheis | 493/133 |

*Primary Examiner*—Stephen Marcus
*Assistant Examiner*—Gary E. Elkins
*Attorney, Agent, or Firm*—Charles E. Brown

[57] ABSTRACT

This relates to a carton or cup having a conventional type of gable end which includes sealing flaps which are heat sealed or bonded to one another. The cup is particularly adapted to be closed by hand wherein control over the sealing flap positions is not possible as in the case of machine closed cups. Accordingly, the intermediate folded sealing flaps are so configurated wherein the folded ends thereof will be spaced so as to define therebetween a leak path. One of the front and rear sealing flaps will be provided with a bead of hot melt material which will be aligned with the leak path and when the sealing flaps are heat bonded together, the hot melt material will melt and fill the leak path.

5 Claims, 5 Drawing Figures

SEALING OF VOID AREA AT THE TOP OF CUP BEAD OF HOT MELT

This invention relates in general to new and useful improvements in the sealing of cups or cartons of the type having gable ends.

Cups and cartons of the type having gable ends and wherein the cups and cartons are formed of a paperboard material having self-bonding face surfaces, are well known. Normally these gable ends are machined closed wherein absolute control of the folding of the gable ends, and most particularly the sealing flaps thereof, is possible. However, when the gable ends are not machined closed, but are manually closed, either the folded ends of the folded sealing flaps have a tendency to overlap and wedge the closure open, or they do not totally come together and thus leave a leak path in the closed carton.

This invention relates to a solution of sealing closed the gable ends of a carton or cup when the closing is manually effected.

Most particularly, the carton blank is of a configuration wherein when the seal flaps of the gable end are folded together to a closing position, the folded ends of the folded sealing flaps are positively spaced from one another. When the sealing flaps are heat bonded together in the normal manner, there remains between the flaps a leak path. This leak path is desired. However, it must be sealed.

According to this invention, there is applied to one of the front and rear sealing flaps a bead of hot melt material which will be aligned with the leak path. The hot melt material will melt at a temperature whereat the sealing flaps are self-bonded together. Thus when the sealing flaps are bonded together to effect a sealing close of the gable end, the hot melt material will melt and fill the leak path. Thus a complete seal is assured.

With the above and other objects in view that will hereinafter appear, the nature of the invention will be more clearly understood by reference to the following detailed description, the appended claims, and the several views illustrated in the accompanying drawing.

IN THE DRAWING

Figure 1:
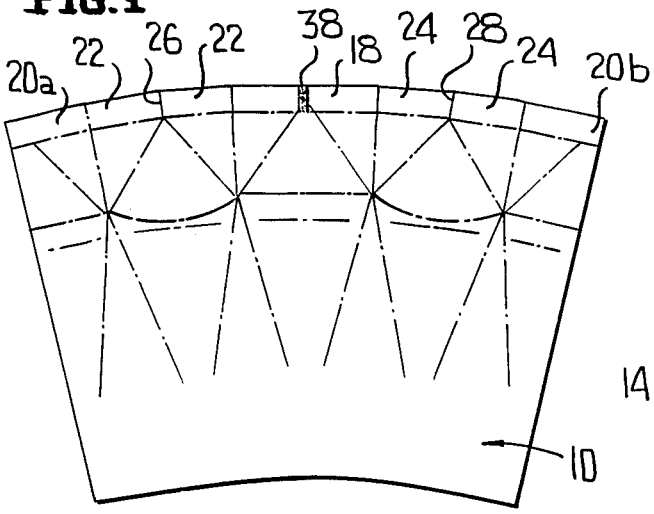
FIG. 1 is a fragmentary plan view of a blank from which a cup or carton in accordance with this invention is formed.
Figure 5:
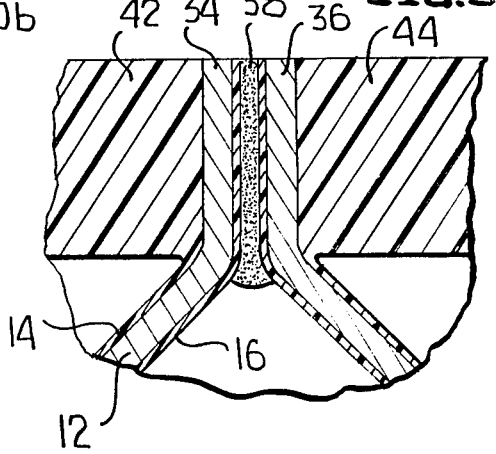
FIG. 5 is an enlarged fragmentary vertical sectional view taken generally along the line 5—5 of FIG. 4 and shows more specifically the closing of the leak path by the hot melt material.

Referring now to the drawing in detail, it will be seen that there is illustrated in FIG. 1 a blank, generally identified by the numeral 10, for forming a cup or carton. The specifically illustrated blank has, as is shown in FIG. 5, a paperboard core 12 and self-bonding plastic facings 14 and 16.

The blank 10 is provided with conventional fold lines in the conventional manner to define a front sealing flap 18, rear sealing flap parts 20*a*, 20*b*, folded sealing flaps 22 and folded sealing flaps 24. The folded sealing flaps 22 are separated by an intermediate fold line 26 while the folded sealing flaps 24 are separated by an intermediate fold line 28.

It is to be understood that the rear sealing flaps 20*a* and 20*b* will be overlapped in the formation of a carton, the carton being identified by the numeral 30. The carton 30 may also be referred to as a cup.

Figure 4:
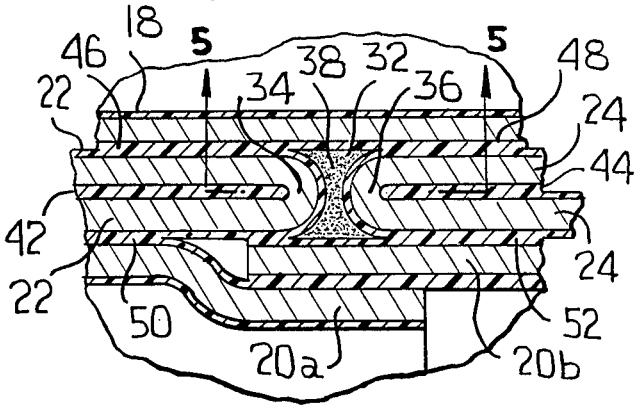
FIG. 4 is an enlarged fragmentary horizontal sectional view taken generally along the line 4—4 of FIG. 3 and shows specifically the seal between the sealing flaps.

The various sealing flaps are separated by fold lines which are so proportioned wherein the front sealing flap 18 will be of a prescribed length and the rear sealing flap formed by the sealing flap portions 20*a*, 20*b* will be of the same length. However, the combined lengths of the folded sealing flaps 22 and the folded sealing flaps 24 will be less than that of the front sealing flap 18, thereby positively preventing overlapping of the folded ends of the folded sealing flaps 22, 24 and leaving between the folded ends of the folded sealing flaps 22, 24 a leak path 32 as is best shown in FIG. 4. At this time the folded end of the folded sealing flaps 22 is identified by the referene numeral 34 and the folded end of the folded sealing flaps 24 is identified by the reference numeral 36.

In addition to specifically forming the blank 10 so that the folded ends 34, 36 will be positively spaced to define the leak path 32, the blank is provided with a bead 38 of a hot melt material, the bead 38 being disposed along the center of the front sealing flap 18 on the inner surface thereof.

Figure 2:
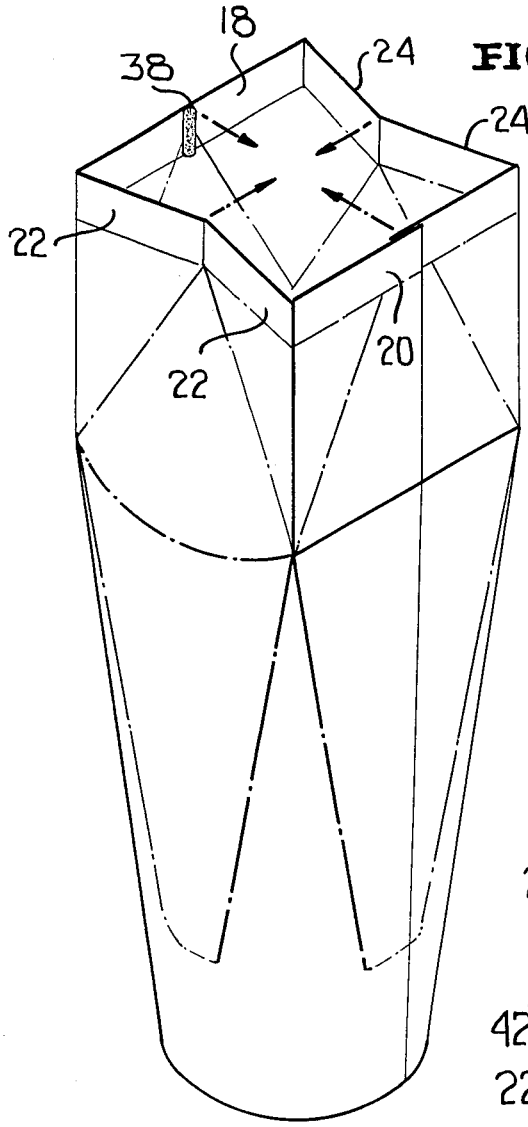
FIG. 2 is an enlarged perspective view of the open carton or cup showing the relationship of the various sealing flaps and the position of the bead of hot melt material.
Figure 3:
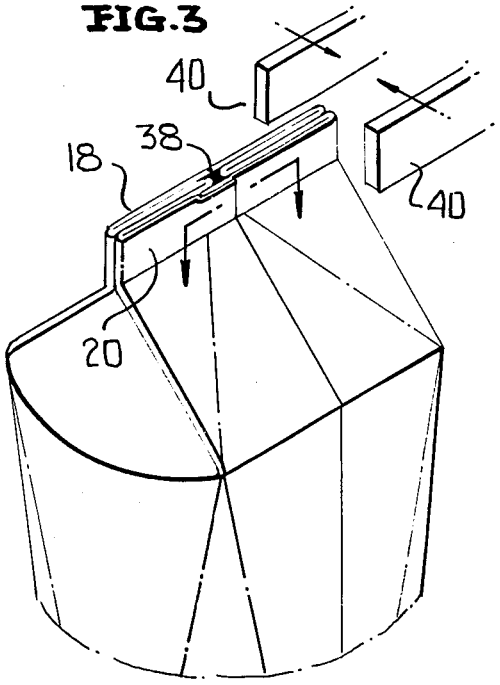
FIG. 3 is a fragmentary top perspective view of the closed carton of FIG. 2 showing the hot melt material melted to close the leak path.

Referring once again to FIG. 2, it will be seen that the cup or carton 30 is illustrated with the top thereof open. At this time the various sealing flaps are widely spaced and the product to be packaged may be readily placed in the cup or carton 30. It will also be seen that the various sealing flaps are carried by gable top forming panels in a conventional manner.

After the necessary product is placed with the cup or carton 30, the sealing flaps 18, 20, 22 and 24 are folded together in the normal manner and placed between a pair of heat sealing bars 40. The heat sealing bars 40 will be clamped together in the customary manner and will apply sufficient heat to the various sealing flaps so that the outer surfaces of the sealing flaps 22 will be heat bonded together as at 42 and the outer surfaces of the sealing flaps 24 will be heat sealed together as at 44. At the same time, the inner surface of the front sealing flap 18 will be heat sealed as at 46 to the inner surface of one of the sealing flaps 22 and as at 48 to the inner surface of one of the heat sealing flaps 24. In a like manner, the heat sealing flap portions 20*a* and 20*b* will be heat sealed respectively to one of the sealing flaps 22 and one of the sealing flaps 24 as at 50 and 52.

The leak path 32, at the same time, will automatically be sealed by the melting and flowing of the bead 38 of hot melt material as is clearly shown in FIGS. 4 and 5.

While the carton or cup 30 and the method of sealing the same closed is particularly adapted for a hand closing and sealing operation, it is to be understood that the same features could be incorporated in a machine closed carton or cup.

Although only a preferred embodiment of the carton or cup has been specifically illustrated and described herein, it is to be understood that minor variations may be made therein without departing from the spirit and scope of the invention as defined by the appended claims.

I claim:

1. A gable top carton wherein when said top is closed a heat seal is formed between front and rear sealing flaps and folded end sealing flaps between said front and rear sealing flaps, the improvement wherein said folded end sealing flaps having aligned folded portions purposely spaced apart to leave an intended void between said front and rear sealing flaps, said carton top being open and there being an intentional leak path between said sealing flaps, and a bead of hot melt material carried by one of said front and rear sealing flaps in alignment with the intended position of said leak path.

2. A carton according to claim 1 wherein said carton is formed from a flat blank, and said bead is applied to the flat blank.

3. A carton according to claim 1 wherein said carton is closed, said hot melt material has remelted and filled said leak path.

4. A method of forming a manually closable gable top carton comprising the steps of forming a blank having heat sealable face surfaces from which said carton may be formed, said blank having top closure panels and sealing flaps defining fold lines with said fold lines defining front and rear sealing flaps and folded sealing flaps with the dimensions of the folded sealing flaps being such that in the folded carton closing state of said carton folded ends of the folded sealing flaps are purposely spaced apart, forming an open to carton from said blank with one of the front and rear sealing flaps having on an inner surface thereof centrally of said inner surface a bead of hot melt, closing the carton with the folded sealing flaps and in intentional spaced relation, heating the sealing flaps to effect self bonding of all of the sealing flaps to one another and melting the hot melt material to fill the intentionally formed space between the front and rear sealing flaps and the folded ends of the folded sealing flaps.

5. A method according to claim 4 wherein the bead of hot melt material is applied to the blank.

* * * * *